US011295688B2

(12) United States Patent
Koo et al.

(10) Patent No.: US 11,295,688 B2
(45) Date of Patent: Apr. 5, 2022

(54) DISPLAY APPARATUS WITH CLOCK SIGNAL MODIFICATION DURING VERTICAL BLANKING PERIOD

(71) Applicant: SAMSUNG DISPLAY CO., LTD., Yongin-si (KR)

(72) Inventors: Jahun Koo, Asan-si (KR); Haksun Kim, Seoul (KR); Kyung-Hun Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/903,746

(22) Filed: Jun. 17, 2020

(65) Prior Publication Data

US 2020/0312262 A1 Oct. 1, 2020

Related U.S. Application Data

(62) Division of application No. 16/511,184, filed on Jul. 15, 2019, which is a division of application No. (Continued)

(30) Foreign Application Priority Data

Apr. 1, 2016 (KR) ..... 10-2016-0040192

(51) Int. Cl.
*G09G 3/36* (2006.01)
*G09G 5/18* (2006.01)

(52) U.S. Cl.
CPC ..... *G09G 3/3677* (2013.01); *G09G 3/3674* (2013.01); *G09G 3/3688* (2013.01); (Continued)

(58) Field of Classification Search
None
See application file for complete search history.

(56) References Cited

U.S. PATENT DOCUMENTS 6,879,313 B1 4/2005 Kubota et al.
8,860,770 B2 10/2014 Jeong et al.
(Continued)

FOREIGN PATENT DOCUMENTS

CN 102436798 5/2012
CN 102568413 7/2012
(Continued)

OTHER PUBLICATIONS

Office Action dated Jan. 8, 2021 in corresponding U.S. Appl. No. 16/511,184.
(Continued)

*Primary Examiner* — Kent W Chang
*Assistant Examiner* — Benjamin Morales
(74) *Attorney, Agent, or Firm* — F. Chau & Associates, LLC

(57) ABSTRACT

A display apparatus includes a display panel comprising a pixel which is connected to a gate line and a data line, a gate driver configured to generate a gate signal having a gate-on voltage and a gate-off voltage and to provide the gate line with the gate signal, and a gate controller configured to generate a clock signal having a duty ratio and to provide the gate driver with the clock signal, where a mean amplitude of the clock signal in a vertical blanking period of a frame cycle is smaller than the mean amplitude of the clock signal in an active period of the frame cycle.

18 Claims, 10 Drawing Sheets

Related U.S. Application Data

15/443,566, filed on Feb. 27, 2017, now Pat. No. 10,395,616.

(52) U.S. Cl.
CPC ..... *G09G 3/3696* (2013.01); *G09G 5/18* (2013.01); *G09G 2300/0417* (2013.01); *G09G 2300/0809* (2013.01); *G09G 2310/0286* (2013.01); *G09G 2310/061* (2013.01); *G09G 2310/08* (2013.01); *G09G 2320/043* (2013.01); *G09G 2330/021* (2013.01); *G09G 2330/025* (2013.01)

(56) References Cited

U.S. PATENT DOCUMENTS

| | | | | |
|---|---|---|---|---|
| 9,070,341 | B2 | 6/2015 | Ji et al. | |
| 9,672,792 | B2 | 6/2017 | Choi et al. | |
| 9,824,659 | B2 | 11/2017 | Gu et al. | |
| 10,395,616 | B2 | 8/2019 | Koo et al. | |
| 2006/0227094 | A1 | 10/2006 | Park et al. | |
| 2010/0277206 | A1 | 11/2010 | Lee et al. | |
| 2011/0069044 | A1 | 3/2011 | Lee et al. | |
| 2011/0169789 | A1* | 7/2011 | Yamaguchi | G09G 3/3677 345/204 |
| 2012/0068994 | A1 | 3/2012 | Li et al. | |
| 2013/0335392 | A1* | 12/2013 | Cho | G11C 19/28 345/211 |
| 2014/0035891 | A1 | 2/2014 | Tanaka | |
| 2014/0111495 | A1 | 4/2014 | Iwase | |
| 2015/0015620 | A1 | 1/2015 | Yokonuma | |
| 2015/0268777 | A1 | 9/2015 | Okamura | |
| 2017/0287425 | A1 | 10/2017 | Koo et al. | |
| 2017/0372654 | A1 | 12/2017 | So et al. | |
| 2019/0340990 | A1 | 11/2019 | Koo et al. | |

FOREIGN PATENT DOCUMENTS

| | | |
|---|---|---|
| CN | 102740090 | 10/2012 |
| CN | 102930839 | 2/2013 |
| CN | 105047168 | 11/2015 |
| JP | 2001-4981 | 1/2001 |
| JP | 2006-284708 | 10/2006 |

OTHER PUBLICATIONS

Office Action dated Jul. 3, 2020 in corresponding Chinese Patent Appln. No. 201710182166.3 (8 pages).

Office Action dated Oct. 6, 2021 in corresponding U.S. Appl. No. 16/511,184.

* cited by examiner

DISPLAY APPARATUS WITH CLOCK SIGNAL MODIFICATION DURING VERTICAL BLANKING PERIOD

CROSS-REFERENCE TO RELATED APPLICATIONS

This application is a divisional of U.S. patent application Ser. No. 16/511,184, filed Jul. 15, 2019, which is a divisional of U.S. patent application Ser. No. 15/443,566, filed Feb. 27, 2017, which claims priority under 35 USC § 119 from and the benefit of Korean Patent Application No. 10-2016-0040192 filed on Apr. 1, 2016, all of which are hereby incorporated by reference for all purposes as if fully set forth herein.

TECHNICAL FIELD

Exemplary embodiments of the inventive concept relate to a display apparatus. More particularly, an exemplary embodiment of the inventive concept relates to a display apparatus for stabilizing a driver circuit and improving display quality.

DISCUSSION OF RELATED ART

Generally, a liquid crystal display ("LCD") apparatus includes an LCD panel displaying images using light transmittance of a liquid crystal, and a backlight assembly disposed under the LCD panel and providing light to the LCD panel.

The LCD panel includes a plurality of gate lines, a plurality of data lines, and a plurality of pixels connected therebetween, and the LCD apparatus further includes a gate driving circuit providing gate signals to the gate lines and a data driving circuit providing data signals to the data lines. The gate and data driving circuits are conventionally mounted on the LCD panel with a chip shape.

The gate driving circuit may be integrated on a glass-based display substrate of an LCD panel such as an amorphous silicon gate (ASG) type of gate driving circuit. The ASG type of gate driving circuit may decrease costs of manufacturing the LCD panel.

SUMMARY

Exemplary embodiments of the inventive concept provide a display apparatus for preventing deterioration and improving display quality.

According to an exemplary embodiment of the inventive concept, there is provided a display apparatus. The display apparatus includes a display panel comprising a pixel which is connected to a gate line and a data line, a gate driver configured to generate a gate signal having a gate-on voltage and a gate-off voltage and to provide the gate line with the gate signal, and a gate controller configured to generate a clock signal having a duty ratio and to provide the gate driver with the clock signal, the duty ratio of the clock signal in a vertical blanking period of a frame cycle being smaller than the duty ratio of the clock signal in an active period of the frame cycle.

In an exemplary embodiment, the clock signal may maintain a low level during at least one horizontal period in the vertical blanking period.

In an exemplary embodiment, the clock signal may have duty ratios gradually decreasing from an early portion of the vertical blanking period to a middle portion of the vertical blanking period, and gradually increasing from the middle portion of the vertical blanking period to a late portion of the vertical blanking period.

In an exemplary embodiment, the clock signal may swing between the gate-on voltage and the gate-off voltage in the vertical blanking period, the gate-off voltage being lower than a ground voltage.

In an exemplary embodiment, the gate controller may be configured to generate a first clock signal and a second clock signal having a phase opposite to the first clock signal in the vertical blanking period.

In an exemplary embodiment, the display apparatus may further include a timing controller configured to mask a control pulse of an original clock control signal in the vertical period to generate a clock control signal, and to provide the gate controller with the clock control signal According to an exemplary embodiment of the inventive concept, there is provided a display apparatus. The display apparatus includes a display panel comprising a pixel which is connected to a gate line and a data line; a gate driver configured to generate a gate signal having a gate-on voltage and a gate-off voltage and to provide the gate line with the gate signal, and a gate controller configured to generate a clock signal having a high level and low level and to provide the gate driver with the clock signal, a high level of the clock signal in a vertical blanking period of a frame cycle being lower than a high level of the clock signal in an active period of the frame cycle.

In an exemplary embodiment, the clock signal may have a duty ratio and a duty ratio of the clock signal in the vertical blanking period is equal to a duty ratio of the clock signal in the active period.

In an exemplary embodiment, the clock signal may maintain a low level during at least one horizontal period in the vertical blanking period.

In an exemplary embodiment, the vertical blanking period may include an early portion, a middle portion and a late portion, and the clock signal maintains the low level in the middle portion.

In an exemplary embodiment, the clock signal may swing between a ground voltage and a gate-off voltage being lower than the ground voltage in the vertical blanking period.

In an exemplary embodiment, the display apparatus may further include a driving voltage generator configured to generate the gate-on voltage and the gate-off voltage using an input voltage, and the clock signal swings between the input voltage and a gate-off voltage being lower than the input voltage.

In an exemplary embodiment, the gate controller may be configured to generate a first clock signal and a second clock signal having a same phase as the first clock signal in the vertical blanking period.

In an exemplary embodiment, the gate controller may be configured to generate a first clock signal and a second clock signal having an opposing phase to the first clock signal in the vertical blanking period.

According to an exemplary embodiment of the inventive concept, there is provided a display apparatus. The display apparatus includes a display panel comprising a pixel which is connected to a gate line and a data line, a gate driver configured to generate a gate signal having a gate-on voltage and a gate-off voltage and to provide the gate line with the gate signal, and a gate controller configured to generate a clock signal having a high level and a low level and to provide the gate driver with the clock signal, wherein the clock signal swings between the high level and the low level in an early portion and a late portion of the vertical blanking period, and maintains the low level in a middle portion of the vertical blanking period.

In an exemplary embodiment, the clock signal may have a duty ratio, and a duty ratio of the clock signal in the early and late portions of the vertical blanking period may be equal to a duty ratio of the clock signal in the active period.

In an exemplary embodiment, the clock signal may swing between the gate-on voltage and the gate-off voltage being lower than a ground voltage in the vertical blanking period.

In an exemplary embodiment, the early, middle and late portions of the vertical blanking period may include a plurality of horizontal periods, respectively.

In an exemplary embodiment, the gate controller may be configured to generate a first clock signal and a second clock signal having a same phase as the first clock signal in the vertical blanking period.

In an exemplary embodiment, the gate controller may be configured to generate a first clock signal and a second clock signal having an opposing phase to the first clock signal in the vertical blanking period.

According to an exemplary embodiment of the inventive concept, a display apparatus is provided including: a display panel comprising having a pixel which is connected to between a gate line and a data line; a gate driver connected to the gate line and configured to generate a gate signal having at least one gate-on voltage and at least one gate-off voltage and to provide the gate line with the gate signal; and a gate controller connected to the gate driver and configured to generate a clock signal having at least one high level and at least one low level a duty ratio and to provide the gate driver with the clock signal, wherein a mean amplitude of the clock signal in a vertical blanking period of a frame cycle is smaller than the mean amplitude of the clock signal in an active period of the frame cycle.

In an exemplary embodiment, the display apparatus is optionally provided where a duty ratio of the clock signal in a vertical blanking period of a frame cycle being is smaller than the duty ratio of the clock signal in an active period of the frame cycle.

In an exemplary embodiment, the display apparatus is optionally provided where a high level of the clock signal in a vertical blanking period of a frame cycle is lower than a high level of the clock signal in an active period of the frame cycle.

In an exemplary embodiment, the display apparatus is optionally provided where the clock signal swings between the high level and the low level in an early portion and a late portion of the vertical blanking period, and maintains the low level in a middle portion of the vertical blanking period.

In an exemplary embodiment, the display apparatus is optionally provided where the at least one gate-on voltage of the gate signal is substantially the same as the at least one high level of the clock signal.

In an exemplary embodiment, the display apparatus is optionally provided where the at least one gate-off voltage of the gate signal is different than the at least one low level of the clock signal.

In an exemplary embodiment, the display apparatus is optionally provided where the gate controller generates first and second clock signals, the first and second clock signals having substantially opposite phase in an active period of the frame cycle, and having substantially the same phase in a vertical blanking period of the frame cycle.

According to the inventive concept, toggling of the first and second clock signals may decrease in the vertical blanking period and thus, consumption of electrical power may decrease. In addition, the ON period in which the first and second clock signals have the gate-on voltage may decrease in the vertical blanking period and thus, the transistors of the gate driver may be prevented from being degraded. In addition, the first and second clock signals in the vertical blanking period may have a similar waveform as those in the active period. Thus, a load change may decrease in a boundary period between the vertical blanking period and the active period and power supply ripple noise occurring by the load change may be removed.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION

Figure 1:
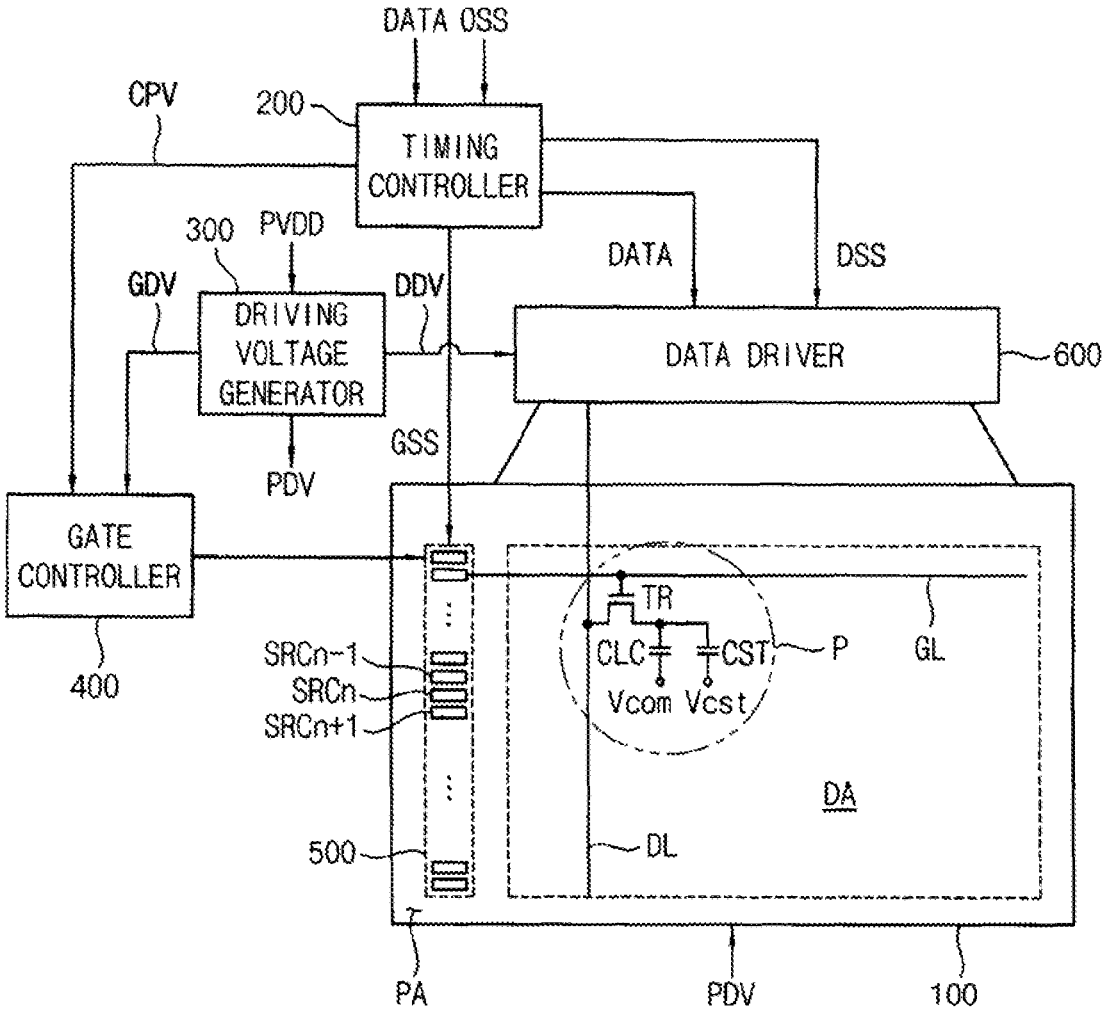
FIG. 1 is a block diagram illustrating a display apparatus according to an exemplary embodiment.

The terminology used herein is for the purpose of describing particular embodiments only and is not intended to be limiting of the invention. As used herein, the singular forms, "a", "an" and "the" are intended to include the plural forms as well, unless the context clearly indicates otherwise.

It shall be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. It should be understood that for the purposes of this disclosure, "at least one of X, Y, and Z" can be construed as X only, Y only, Z only, or any combination of two or more items X, Y, and Z.

Hereinafter, the inventive concept will be explained in detail by means of example with reference to the accompanying drawings. In the drawings, the size and relative sizes of layers and regions may be exaggerated for clarity. Like reference indicia in the drawings may denote like elements.

FIG. 1 is a block diagram illustrating a display apparatus according to an exemplary embodiment.

Referring to FIG. 1, the display apparatus may include a display panel 100, a timing controller 200 connected to the display panel, a driving voltage generator 300, a gate controller 400 connected between the driving voltage generator and the display panel, a gate driver 500 connected to the gate controller and disposed in the display panel, and a data driver 600 connected between the timing controller and the display panel.

The display panel 100 may include a display area DA and a peripheral area PA surrounding the display area DA. A plurality of gate lines GL, a plurality of data lines DL and a plurality of pixels P are disposed in the display area DA. A pixel P may include a switching element TR which is electrically connected to a gate line GL and a data line DL, a liquid crystal (LC) capacitor CLC which is electrically connected to the switching element TR and a storage capacitor CST which is electrically connected to the LC capacitor CLC. The gate driver may be disposed in the peripheral area PA of the display panel 100, but is not limited thereto.

The timing controller 200 is configured to generally control an operation of the display apparatus. The timing controller 200 is configured to receive an image signal DATA and an original synchronization signal OSS.

The timing controller 200 is configured to generate a display synchronization signal for driving the display apparatus based on the original synchronization signal OSS. The display synchronization signal may include a gate synchronization signal GSS for driving the gate driver 500 and a data synchronization signal DSS for driving the data driver 600.

According to an exemplary embodiment, the gate synchronization signal GSS may include a vertical start signal STV, a clock control signal CPV, a blanking enable signal BEN, etc. The clock control signal CPV may be controlled based on the blanking enable signal BEN.

The vertical start signal STV is a control signal which starts an operation of the gate driver 500, the clock control signal CPV is a control signal which controls a plurality of clock signals to be provided to the gate driver 500, and the blanking enable signal BEN is a control signal which identifies a vertical blanking period in a frame cycle.

The data synchronization signal DSS may include a data enable signal, a horizontal synchronization signal, a vertical synchronization signal, a pixel clock signal, etc.

The driving voltage generator 300 is configured to generate a plurality of driving voltages using an input voltage PVDD. The plurality of driving voltages may include a gate driving voltage GDV for driving the gate line, a data driving voltage DDV for driving a data line and a panel driving voltage PDV for driving the display panel 100. The gate driving voltage GDV may include a gate-on voltage, a plurality of gate-off voltages, etc., the data driving voltage DDV may include an analog source voltage, a digital source voltage, etc., and the panel driving voltage PDV may include a common voltage Vcom, a storage voltage Vcst, etc.

The gate-on voltage and the plurality of gate-off voltages are used to generate a gate signal to be applied to the gate line GL. The analog source voltage and the digital source voltage are used to generate a data voltage to be applied to the data line DL. The common voltage Vcom is applied to the LC capacitor CLC and the storage voltage Vcst is applied to the storage capacitor CST. The storage voltage Vcst may have a voltage level being equal to that of the common voltage Vcom.

The gate controller 400 is configured to generate a plurality of clock signals using the gate-on voltage and the second gate-off voltage in response to the clock control signal CPV received from the timing controller 200. During the active period of the frame cycle, a first clock signal may have a phase opposite to that of a second clock signal. However, during the vertical blanking period of the frame cycle, waveforms of the first and second clock signals may be different from those of the first and second clock signals in the active period. For example, a duty ratio, a high level or a repeated cycle of the first and second clock signals in the vertical blanking period may be different from those of the first and second clock signals in the active period.

The gate driver 500 may include a plurality of shift registers SRCn−1, SRCn and SRCn+1 which is configured to sequentially generate a plurality of gate signals in synchronization with a plurality of clock signals (wherein, 'n' is a natural number). The shift registers SRCn−1, SRCn and SRCn+1 may be respectively connected to first ends of the gate lines GL and disposed in the peripheral area PA adjacent to ends of the gate lines GL.

The data driver 600 is configured to convert image data to the data voltage based on the data synchronization signal DSS and to output the data voltage to the data lines DL.

Figure 2:
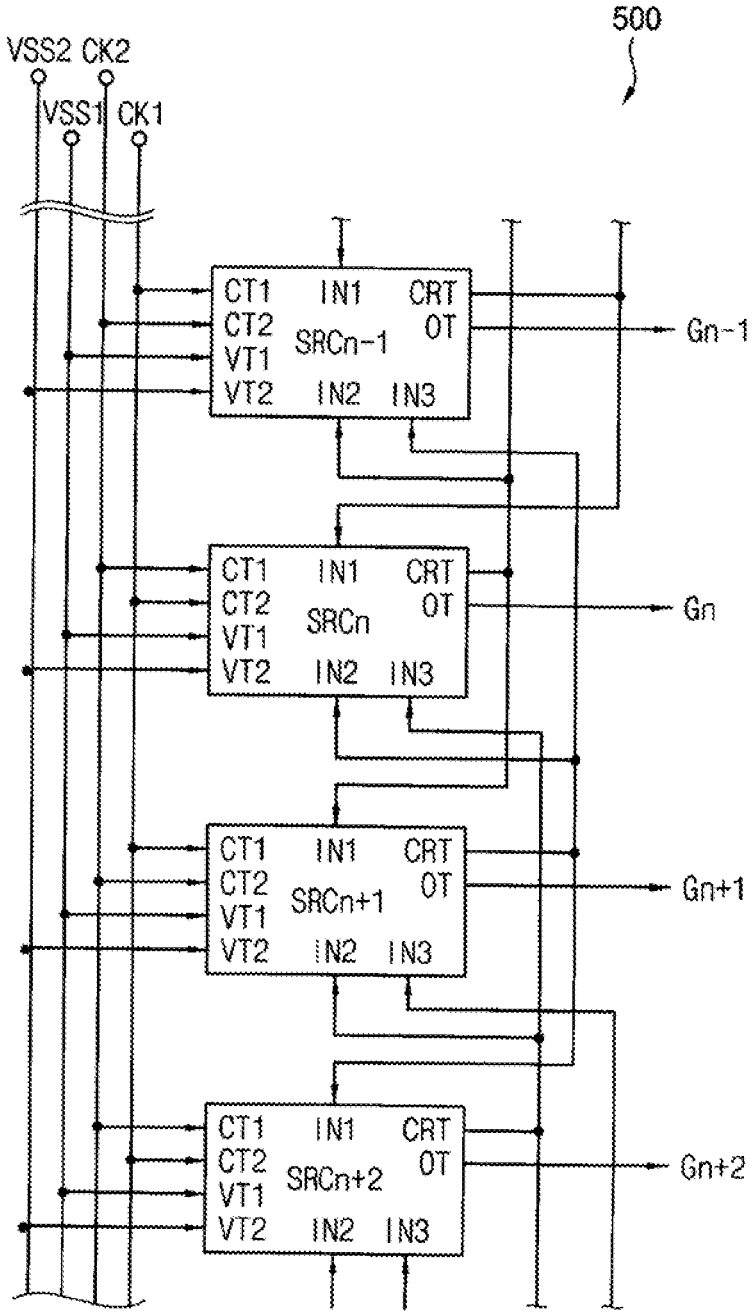
FIG. 2 is a block diagram illustrating a gate driver according to an exemplary embodiment.

FIG. 2 is a block diagram illustrating a gate driver according to an exemplary embodiment.

Referring to FIGS. 1 and 2, the gate driver 500 may include a plurality of shift registers SRCn−1, SRCn, SRCn+1 and SRCn+2 which is connected to each other in a cascade control mode (wherein, 'n' is a natural number).

The (n−1)-th, n-th, (n+1)-th and (n+2)-th shift registers SRCn−1, SRCn, SRCn+1 and SRCn+2 are respectively connected to (n−1)-th, n-th, (n+1)-th and (n+2)-th gate lines and are configured to sequentially output (n−1)-th, n-th, (n+1)-th and (n+2)-th gate signals Gn−1, Gn, Gn+1 and Gn+2 to the (n−1)-th, n-th, (n+1)-th and (n+2)-th gate lines.

A shift register may include a first clock terminal CT1, a second clock terminal CT2, a first input terminal IN1, a second input terminal IN2, a third input terminal IN3, a first voltage terminal VT1, a second voltage terminal VT2, a carry terminal CRT and an output terminal OT.

In an active period of the frame cycle, the first clock terminal CT1 is configured to receive a first clock signal CK1 or a second clock signal CK2 being different from the first clock signal. For example, the second clock signal CK2 may have a phase opposite to that of the first clock signal CK1. For example, odd-numbered shift registers SRCn−1 and SRCn+1 may include the first clock terminal CT1 configured to receive the first clock signal CK1 and even-numbered shift registers SRCn and SRCn+2 may include the first clock terminal CT1 configured to receive the second clock signal CK2.

The first input terminal IN1 is configured to receive a previous carry signal outputted from one of previous shift registers. For example, the n-th shift register SRCn may include the first input terminal IN1 configured to receive an (n−1)-th carry signal CRn−1 outputted from the (n−1)-th shift register SRCn−1.

The second input terminal IN2 is configured to receive a next carry signal outputted from one of next shift registers.

For example, the n-th shift register SRCn may include the second input terminal IN2 configured to receive an (n+1)-th carry signal outputted from the (n+1)-th shift register SRCn+1.

The third input terminal IN3 is configured to receive a next carry signal outputted from one of next shift registers except for the shift register corresponding to the next carry signal received in the second input terminal IN2. For example, n-th shift register SRCn may include the third input terminal IN3 configured to receive an (n+2)-th carry signal CRn+2 outputted from the (n+2)-th shift register SRCn+2.

The first voltage terminal VT1 is configured to receive a first gate-off voltage VSS1. The first gate-off voltage VSS1 has a first low level and the first low level may correspond to a discharge level of the gate signal. For example, the first low level may be about −6 V.

The second voltage terminal VT2 is configured to receive a second gate-off voltage VSS2 having a second low level lower than the first low level VSS1. The second low level may correspond to a discharge level of a control node Q in the shift register. For example, the second low level may be about −10 V.

The carry terminal CRT is configured to output a carry signal. The carry terminal CRT may be connected to the first input terminal IN1 of one of next shift registers and to second or third input terminals IN2 or IN3 of at least two of previous shift registers, respectively. For example, the carry terminal CRT of the (n+1)-th shift register SRCn+1 may be connected to the first input terminal IN1 of the (n+2)-th shift register SRCn+1, to the second input terminal IN2 of the n-th shift register SRCn and to the third input terminal IN3 of the (n−1)-th shift register SRCn−1.

The output terminal OT is electrically connected to a corresponding gate line and configured to output the gate signal to the corresponding gate line. The output terminals OT of the (n−1)-th, n-th, (n+1)-th and (n+2)-th shift registers SRCn−1, SRCn, SRCn+1 and SRCn+2 may sequentially output (n−1)-th, n-th, (n+1)-th and (n+2)-th gate signals Gn−1, Gn, Gn+1 and Gn+2. Each of the (n−1)-th, n-th, (n+1)-th and (n+2)-th gate signals Gn−1, Gn, Gn+1 and Gn+2 may have the gate-on voltage VON and the first gate-off voltage VSS1.

Figure 3:
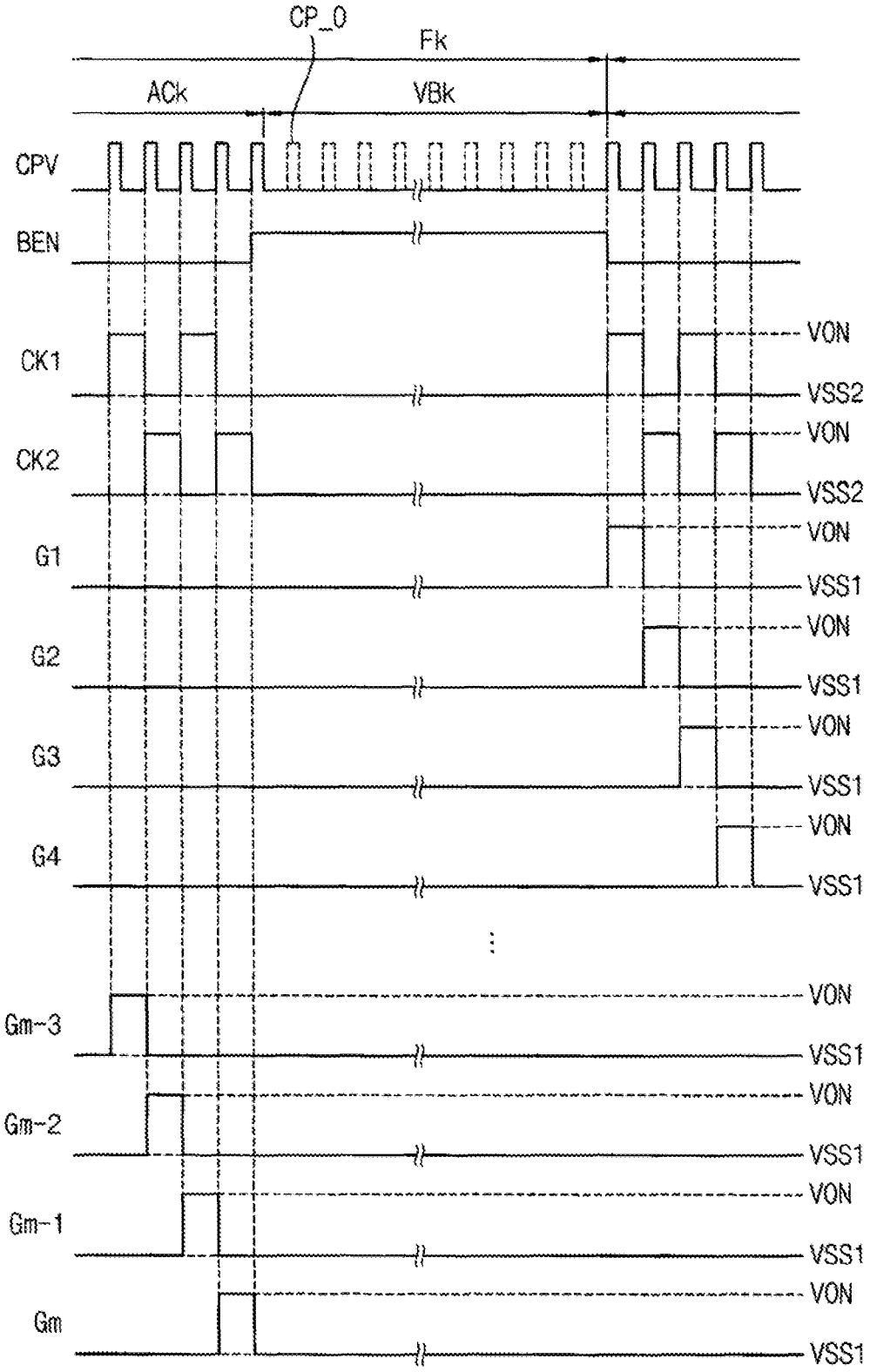
FIG. 3 is a timing chart illustrating a plurality of driving signals for driving a gate driver according to an exemplary embodiment.
Figure 4:
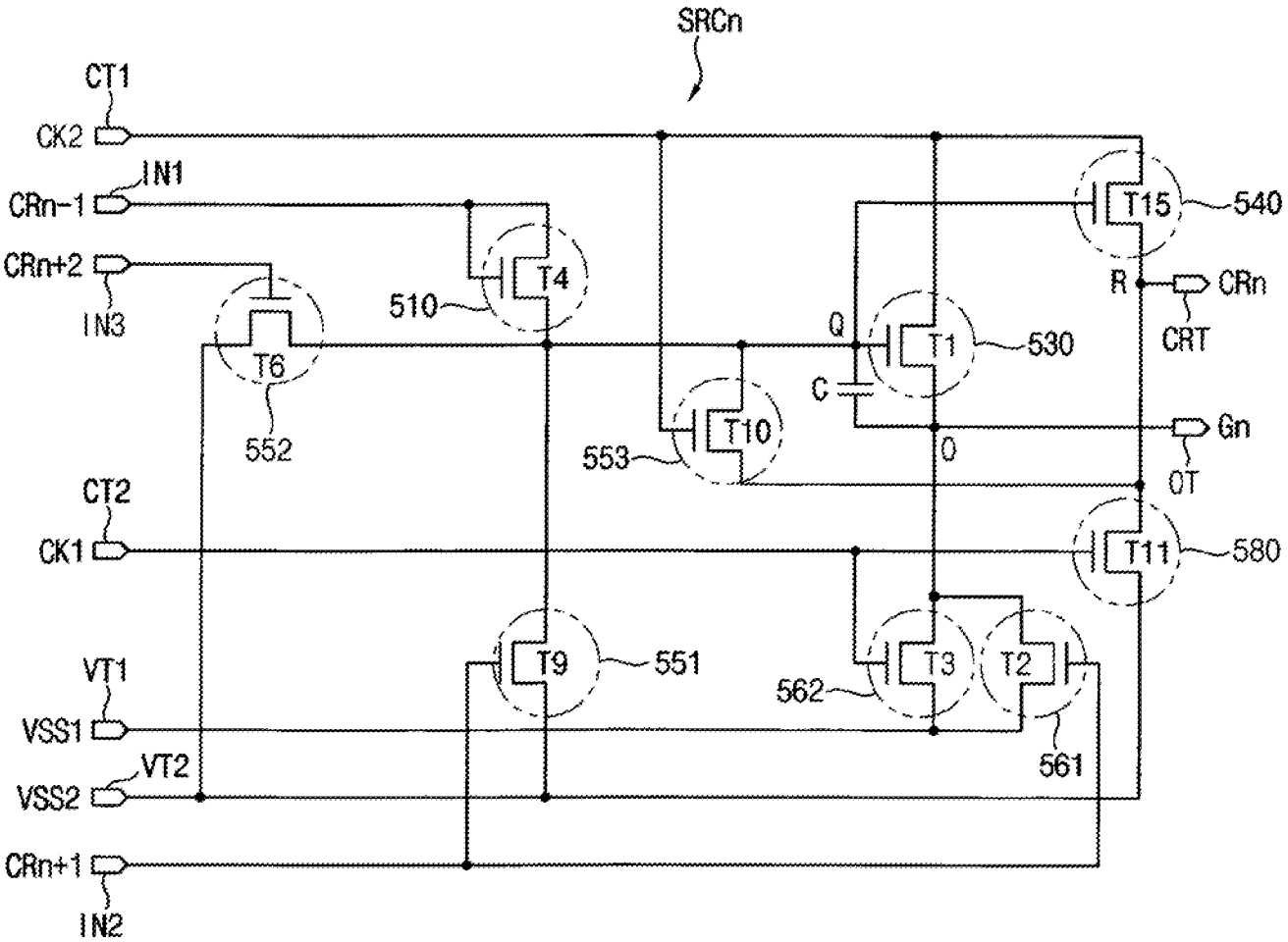
FIG. 4 is a circuit diagram illustrating an n-th shift register of a gate driver according to an exemplary embodiment.

FIG. 3 is a timing chart illustrating a plurality of driving signals for driving a gate driver according to an exemplary embodiment. FIG. 4 is a circuit diagram illustrating an n-th shift register of a gate driver according to an exemplary embodiment.

Referring to FIGS. 3 and 4, the n-th shift register SRCn may include a buffer part 510, a pull-up part 530, a carry part 540, a first control pull-down part 551, a second control pull-down part 552, a control holding part 553, an output pull-down part 561, an output holding part 562 and a carry holding part 580.

The buffer part 510 is configured to transfer the (n−1)-th carry signal CRn−1 to a control node Q. The buffer part 510 may include a fourth transistor T4. The fourth transistor T4 includes a control electrode and an input electrode connected to the first input terminal IN1, and an output electrode connected to the control node Q.

When the buffer part 510 receives the gate-on voltage VON of the (n−1)-th carry signal CRn−1, a first voltage corresponding to the gate-on voltage VON is applied to the control node Q.

The pull-up part 530 is configured to output an n-th gate signal Gn. The pull-up part 530 includes a first transistor T1. The first transistor T1 includes a control electrode connected to the control node Q, an input electrode connected to the first clock terminal CT1 and an output electrode connected to output node O. The output node O is connected to the output terminal OT.

When the first clock terminal CT1 receives the gate-on voltage VON of the second clock signal CK2 on condition that the first voltage V1 of the control node Q is applied to the control electrode of the pull-up part 530, the pull-up part 530 boosts up the first voltage V1 of the control node Q to a boosting voltage VBT. The control node Q may have the first voltage V1 during an (n−1)-th horizontal period in the frame cycle and have the boosting voltage VBT during an n-th horizontal period in the frame cycle.

During the n-th horizontal period Tn in which the boosting voltage VBT is applied to the control electrode of the pull-up part 530, the pull-up part 530 is configured to output the gate-on voltage VON of the second clock signal CK2 as the gate-on voltage VON of the n-th gate signal Gn. The n-th gate signal Gn is outputted through the output terminal OT connected to the output node O.

The carry part 540 is configured to output an n-th carry signal CRn. The carry part 540 includes a fifteenth transistor T15. The fifteenth transistor T15 includes a control electrode connected to the control node Q, an input electrode connected to the first clock terminal CT1 and an output electrode connected to the carry node R.

The carry part 540 is configured to output the gate-on voltage VON of the second clock signal CK2 received in the first clock terminal CT1 as the n-th carry signal CRn in response to a high voltage of the control node Q. The n-th carry signal CRn is outputted through the carry terminal CRT connected to the carry node R.

The first control pull-down part 551 and second control pull-down part 552 are configured to sequentially discharge the control node Q to the second gate-off voltage VSS2 in response to the (n+1)-th carry signal CRn+1 and the (n+2)-th carry signal CRn+1.

The first control pull-down part 551 includes a ninth transistor T9. The ninth transistor T9 includes a control electrode connected to the second input terminal IN2, an input electrode connected to the control node Q and an output electrode connected to the second voltage terminal VT2.

When the gate-on voltage VON of the (n+1)-th carry signal CRn+1 is applied to the second input terminal IN2 in the (n+1)-th horizontal period, the ninth transistor T9 is configured to discharge the control node Q to the second gate-off voltage VSS2 applied to the second voltage terminal VT2.

The second control pull-down part 552 includes a sixth transistor T6. The sixth transistor T6 includes a control electrode connected to a third input terminal IN3, an input electrode connected to the control node Q and an output electrode connected to the second voltage terminal VT2.

When the gate-on voltage VON of an (n+2)-th carry signal CRn+2 is applied to the third input terminal IN3 in an (n+2)-th horizontal period, the sixth transistor T6 is configured to discharge the control node Q to the second gate-off voltage VSS2 applied to the second voltage terminal VT2.

The control holding part 553 is configured to maintain the control node Q to the voltage of the carry node R. The control holding part 553 includes a tenth transistor T10. The tenth transistor T10 includes a control electrode connected to the first clock terminal CT1, an input electrode connected to the control node Q and an output electrode connected to the carry node R. The control holding part 553 is configured to maintain the control node Q to the second gate-off voltage VSS2 in response to the gate-on voltage VON of the second clock signal CK2 applied to the first clock terminal CT1 during a remaining frame cycle except for the n-th horizontal period.

The output pull-down part 561 is configured to pull-down the n-th gate signal Gn. The output pull-down part 561 includes a second transistor T2. The second transistor T2 includes a control electrode connected to the second input terminal IN2, an input electrode connected to the output node O and an output electrode connected to the first voltage terminal VT1. When an (n+1)-th carry signal CRn+1 is applied to the second input terminal IN2, the output pull-down part 561 is configured to pull down the output node O to the first gate-off voltage VSS1 applied to the first voltage terminal VT1. The first gate-off voltage VSS1 may be about −6 V.

The output holding part 562 is configured to maintain the output node O to the first gate-off voltage VSS1. The output holding part 562 includes a third transistor T3. The third transistor T3 includes a control electrode connected to the second clock terminal CT2, an input electrode connected to the output node O and an output electrode connected to the first voltage terminal VT1. The output holding part 562 is configured to maintain the output node O to the first gate-off voltage VSS1 applied to the first voltage terminal VT1 in response to the gate-on voltage VON of the first clock signal CK1 applied to the second clock terminal CT2 during a remaining frame cycle except for the n-th horizontal period.

The carry holding part 580 is configured to maintain the carry node R to the second gate-off voltage VSS2. The carry holding part 580 includes an eleventh transistor T11. The eleventh transistor T11 includes a control electrode connected to the second clock terminal CT2, an input electrode connected to the carry node R and an output electrode connected to the second voltage terminal VT2. The carry holding part 580 is configured to maintain the carry node R to the second gate-off voltage VSS2 in response to the gate-on voltage VON of the first clock signal CK1 applied to the second clock terminal CT2 during a remaining frame cycle except for the n-th horizontal period. However, when the eleventh transistor T11 turn-on in response to the gate-on voltage VON of the first clock signal CK1, the second gate-off voltage VSS2 is applied to the output electrode of the tenth transistor T10.

As described above, the second clock signal CK2 is directly applied to the tenth transistor T10 of the control holding part 553, and the first clock signal CK1 is directly applied to the third transistor T3 of the output holding part 562 and the eleventh transistor T11 of the carry holding part 580.

The first and second clock signals CK1 and CK2 are signals which swing between the gate-on voltage VON and the second gate-off voltage VSS2, and thus, consumption of electrical power may increase by toggling of the first and second clock signals CK1 and CK2.

In addition, high voltages of the first and second clock signals CK1 and CK2 are consistently applied to the third, tenth and eleventh transistors T3, T10 and T11 during the frame cycle, and thus, the third, tenth and eleventh transistors T3, T10 and T11 may be degraded such as by the shifting of a threshold voltage.

According to the exemplary embodiment, during the vertical blanking period of the frame cycle, the first and second clock signals CK1 and CK2 may be maintained to a low voltage that is the second gate-off voltage VSS2 and thus, consumption of electrical power and degradation of the transistor may be decreased.

For example, referring to FIG. 3, the timing controller 200 is configured to mask a plurality of control pulses CP_O of an original clock control signal in the vertical blanking period VBk using a masking process method and to generate a clock control signal CPV maintaining a low level in the vertical blanking period VBk. A masking process method may use an XOR operator. For example, the masking process method includes generating a masking pulse for masking a control pulse corresponding to the control pulse and masking the control pulse using the masking pulse through the XOR operator.

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to generate the first and second clock signals CK1 and CK2 based on the clock control signal CPV and the blanking enable signal BEN. The first and second clock signals CK1 and CK2 may maintain the second gate-off voltage VSS2 in the vertical blanking period VBk.

Therefore, the first and second clock signals CK1 and CK2 may swing between the gate-on voltage VON and the second gate-off voltage VSS2 in an active period ACk of a k-th frame cycle Fk and maintain the second gate-off voltage VSS2 in the vertical blanking period VBk of the k-th frame cycle Fk (wherein 'k' is a natural number). The second gate-off voltage VSS2 may be a ground voltage (0V) or a low voltage lower than the ground voltage.

According to the exemplary embodiment, in the vertical blanking period VBk, the first and second clock signals CK1 and CK2 do not swing and thus, consumption of electrical power may decrease. In addition, high voltages of the first and second clock signals CK1 and CK2 are not continuously applied to the third, tenth and eleventh transistors T3, T10 and T11 of the gate driver during the frame cycle, and thus, the third, tenth and eleventh transistors T3, T10 and T11 may be prevented from being degraded.

Figure 5:
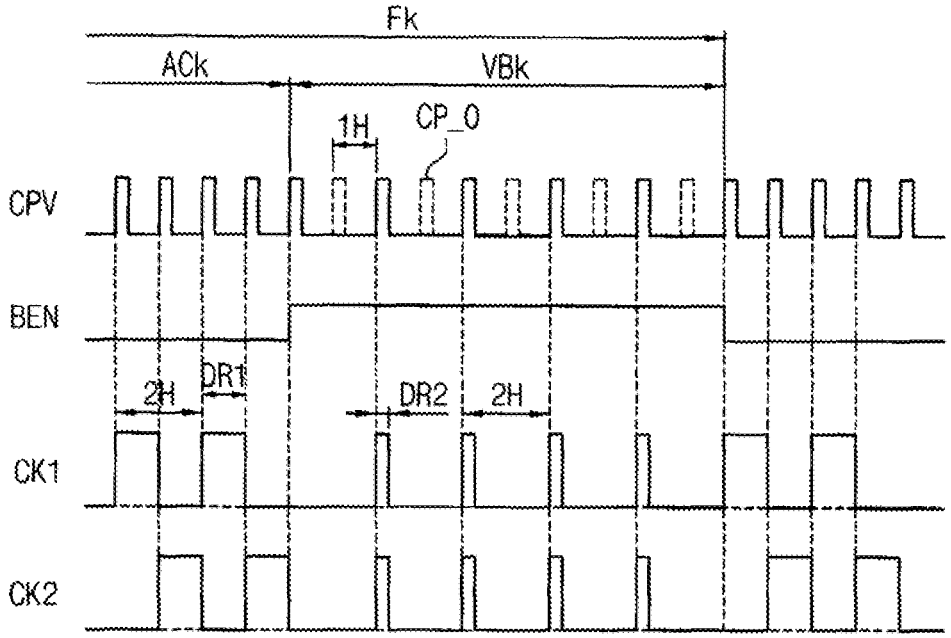
FIG. 5 is a timing chart illustrating a plurality of driving signals for driving a gate driver according to an exemplary embodiment.

FIG. 5 is a timing chart illustrating a plurality of driving signals for driving a gate driver according to an exemplary embodiment.

Referring to FIGS. 1 and 5, according to an exemplary embodiment, the timing controller 200 is configured to mask a control pulse CP_O of an original clock control signal by a predetermined period in the vertical blanking period VBk to generate a clock control signal CPV maintaining a low level during at least 2H in the vertical blanking period VBk.

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to generate the first and second clock signals CK1 and CK2 based on the clock control signal CPV and the blanking enable signal BEN and thus, the first and second clock signals CK1 and CK2 may have a same phase as each other in synchronization with the clock control signal CPV in the vertical blanking period VBk.

In the vertical blanking period VBk, the first and second clock signals CK1 and CK2 may have a second duty ratio DR2 smaller than a first duty ratio DR1 of the first and second clock signals CK1 and CK2 in the active period ACk.

Generally, a duty ratio may be defined as a ratio (ON/OFF) of a high period ON to a low period OFF with respect to one cycle.

As shown in FIG. 5, the first and second clock signals CK1 and CK2 respectively have a first repeated cycle (2H) in the active period ACk and the first and second clock signals CK1 and CK2 respectively have a second repeated cycle (2H) equal to the first repeated cycle (2H) in the vertical blanking period VBk, but not limited thereto. For example, the second repeated cycle of the first and second clock signals CK1 and CK2 in the vertical blanking period VBk may be longer than the first repeated cycle of the first and second clock signals CK1 and CK2 in the active period ACk.

For example, although not shown in figures, the timing controller 200 may be configured to mask a control pulse CP_O of an original clock control signal in the vertical blanking period VBk by every 3H and to generate a clock control signal CPV having a repeated cycle of 3H in the vertical blanking period VBk.

Therefore, the first and second clock signals CK1 and CK2 includes an ON period having the gate-on voltage VON and an OFF period having the second gate-off voltage VSS2 in the vertical blanking period VBk, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring from the load change may be prevented.

Figure 6:
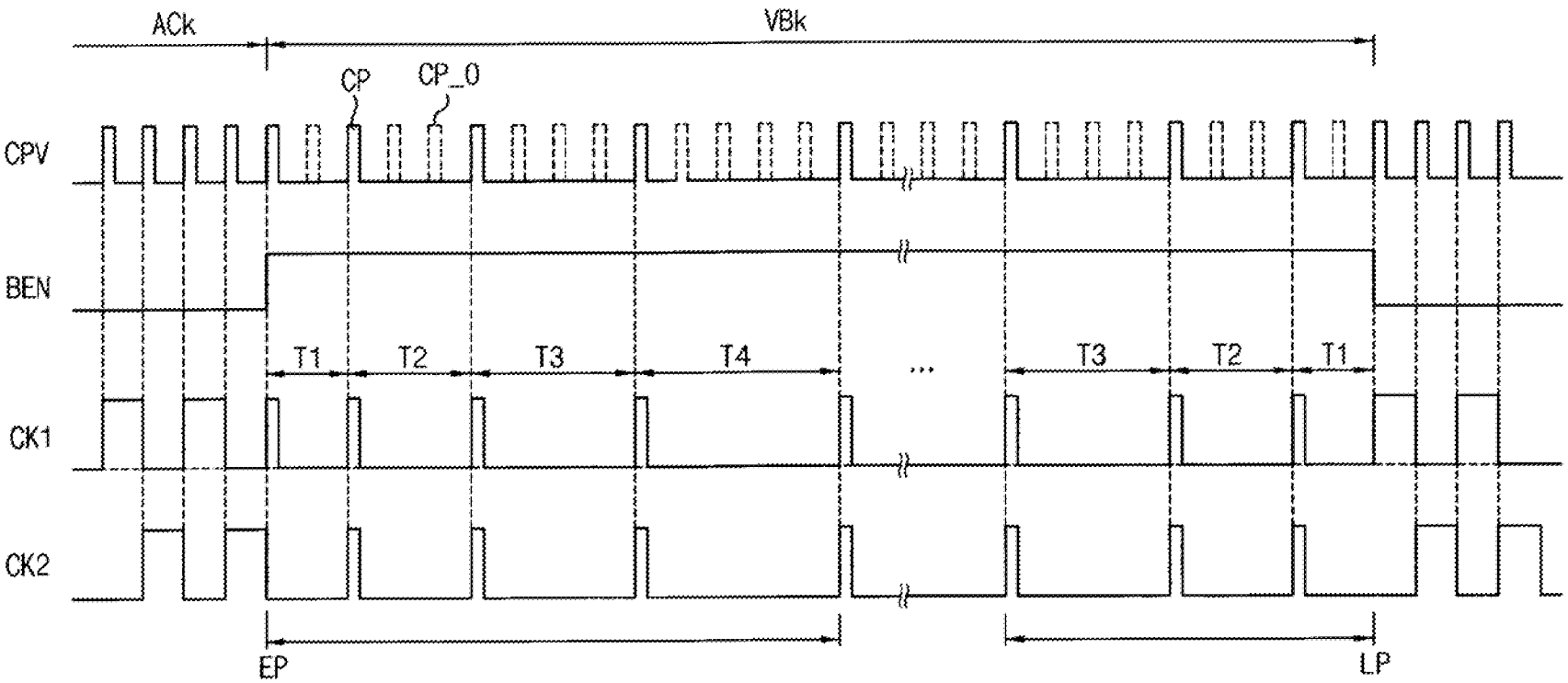
FIG. 6 is a timing chart illustrating a plurality of driving signals for driving a gate driver according to an exemplary embodiment.

FIG. 6 is a timing chart illustrating a plurality of driving signals for driving a gate driver according to an exemplary embodiment.

Referring to FIGS. 1 and 6, according to an exemplary embodiment, the timing controller 200 is configured to mask a control pulse CP_O of an original clock control signal by predetermined periods gradually decreasing and increasing in the vertical blanking period VBk, to generate a clock control signal CPV. The clock control signal CPV includes first control pulses having increasing periods T1, T2, T3, T4, etc., which gradually increase from an early portion EP to a middle portion of the vertical blanking period VBk and second control pulses having decreasing periods . . . , T3, T2, T1 which gradually decrease from the middle portion to a late portion LP of the vertical blanking period VBk.

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to generate the first and second clock signals CK1 and CK2 based on the clock control signal CPV and the blanking enable signal BEN and thus, the first and second clock signals CK1 and CK2 may have a same phase as each other in synchronization with the clock control signal CPV in the vertical blanking period VBk.

During the vertical blanking period VBk, the first and second clock signals CK1 and CK2 have decreasing duty ratios which gradually decrease from the early portion EP to the middle portion of the vertical blanking period VBk and increasing duty ratios which gradually increase from the middle portion to the late portion LP of the vertical blanking period VBk.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

Figure 7:
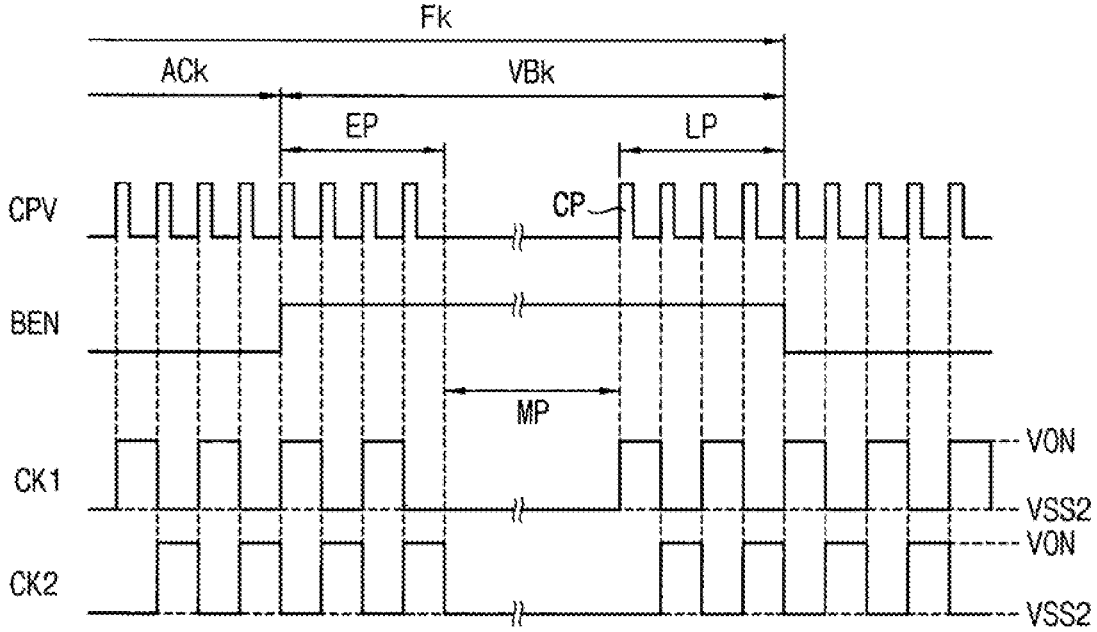
FIG. 7 is a timing chart illustrating a plurality of driving signals for driving a gate driver according to an exemplary embodiment.

FIG. 7 is a timing chart illustrating a plurality of driving signals for driving a gate driver according to an exemplary embodiment.

Referring to FIGS. 1 and 7, according to an exemplary embodiment, the timing controller 200 is configured to mask control pulses of an original clock control signal in a middle portion MP of the vertical blanking period VBk and to not mask control pulses of the original clock control signal in an early and late portions EP and LP of the vertical blanking period VBk, to generate a clock control signal CPV. A length of the early portion EP may be equal to or different from that of the late portion LP. For example, the early and late portions EP and LP may respectively correspond to m horizontal periods (mH) (wherein, 'm' is a natural number and 'H' is a horizontal period).

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to generate the first and second clock signals CK1 and CK2 based on the clock control signal CPV and the blanking enable signal BEN and thus, the first and second clock signals CK1 and CK2 may have an opposing phase to each other in synchronization with the clock control signal CPV in the vertical blanking period VBk. Waveforms of the first and second clock signals CK1 and CK2 in an early portion EP and a late portion LP of the vertical blanking period may be similar to waveforms of the first and second clock signals CK1 and CK2 in the active period ACk. However, the first and second clock signals CK1 and CK2 in the middle portion MP of the vertical blanking period maintain the second gate-off voltage VSS2.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

Figure 8:
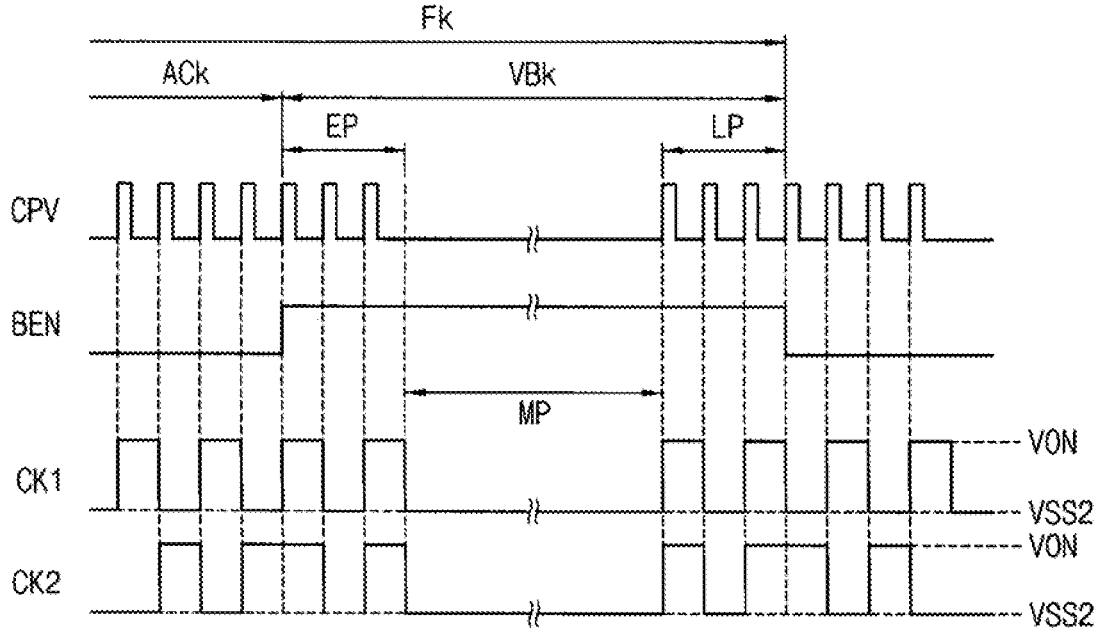
FIG. 8 is a timing chart illustrating a plurality of driving signals for driving a gate driver according to an exemplary embodiment.

FIG. 8 is a timing chart illustrating a plurality of driving signals for driving a gate driver according to an exemplary embodiment.

Referring to FIGS. 1 and 8, according to an exemplary embodiment, the timing controller 200 is configured to mask control pulses of an original clock control signal in a middle portion MP of the vertical blanking period VBk and to not mask control pulses in the original clock control signal corresponding to early and late portions EP and LP of the vertical blanking period VBk, to generate a clock control signal CPV. A length of the early portion EP may be equal to or different from that of the late portion LP. For example, the early and late portions EP and LP may respectively correspond to m horizontal periods (mH) (wherein, 'm' is a natural number and 'H' is a horizontal period).

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to generate the first and second clock signals CK1 and CK2 based on the clock control signal CPV and the blanking enable signal BEN and thus, the first and second clock signals CK1 and CK2 may have a same phase as each other in synchronization with the clock control signal CPV in the vertical blanking period VBk.

Waveforms of the first and second clock signals CK1 and CK2 in an early portion EP and a late portion LP are similar to waveforms of the first and second clock signals CK1 and CK2 in the active period ACk. However, the first and second clock signals CK1 and CK2 in the middle portion MP maintain the second gate-off voltage VSS2.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

Figure 9:
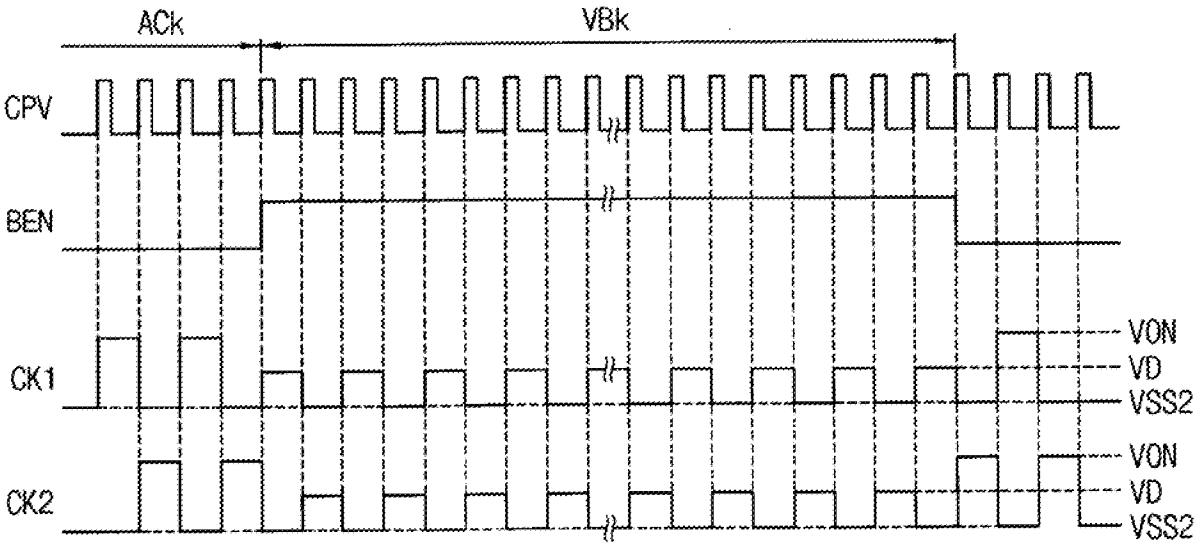
FIG. 9 is a timing chart illustrating a plurality of driving signals for driving a gate driver according to an exemplary embodiment.

FIG. 9 is a timing chart illustrating a plurality of driving signals for driving a gate driver according to an exemplary embodiment.

Referring to FIGS. 1 and 9, according to an exemplary embodiment, the timing controller 200 is configured to generate a clock control signal CPV which includes a plurality of control pulses. The control pulses in a vertical blanking period VBk are a same duty ratio and a same repeated cycle as the control pulses in an active period ACk.

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

According to the exemplary embodiment, the gate controller 400 is configured to receive the clock control signal CPV and the blanking enable signal BEN from the timing controller 200 and to receive a preset voltage VD from the driving voltage generator 300.

The preset voltage VD has a level between the gate-on voltage VON and the second gate-off voltage VSS2. For example, the preset voltage VD may be a ground voltage GND (e.g., about 0 V) or an input voltage PVDD (e.g., about 5 V) which is inputted to the driving voltage generator 300.

The gate controller 400 is configured to generate first and second clock signals CK1 and CK2 based on the clock control signal CPV and the blanking enable signal BEN. The first and second clock signals CK1 and CK2 swing between the preset voltage VD and the second gate-off voltage VSS2 in the vertical blanking period VBk and swing between the gate-on voltage VON and the second gate-off voltage VSS2 in the active period.

The first and second clock signals CK1 and CK2 have an opposing phase to each other. However, the first and second clock signals CK1 and CK2 have a same repeated cycle and a same duty ratio as each other.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

Figure 10:
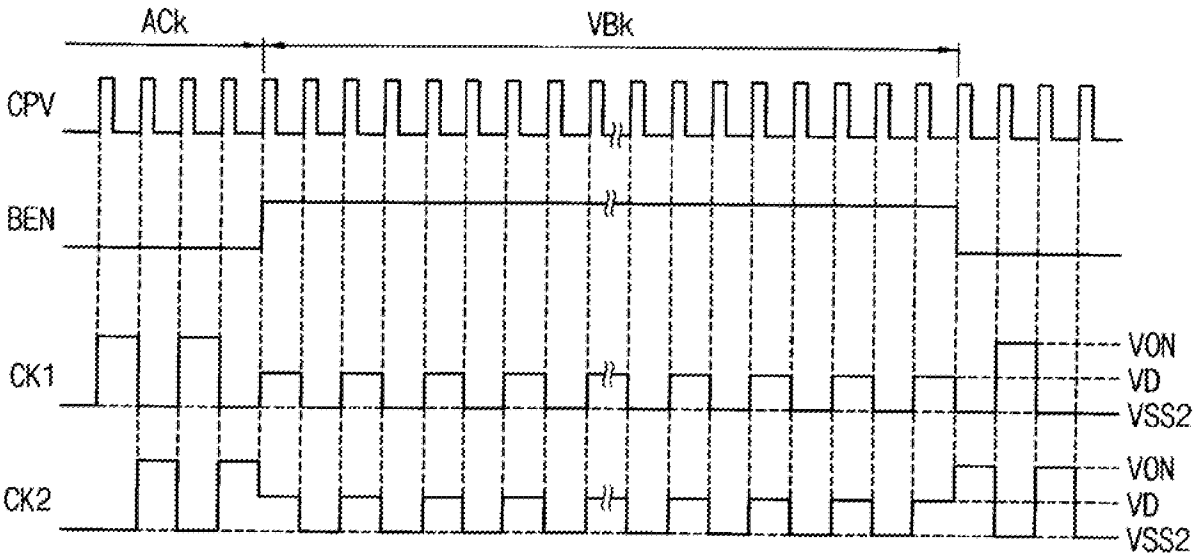
FIG. 10 is a timing chart illustrating a plurality of driving signals for driving a gate driver according to an exemplary embodiment.

FIG. 10 is a timing chart illustrating a plurality of driving signals for driving a gate driver according to an exemplary embodiment.

Referring to FIGS. 1 and 10, according to an exemplary embodiment, the timing controller 200 is configured to generate a clock control signal CPV which includes a plurality of control pulses. The control pulses in a vertical blanking period VBk have a same duty ratio and a same repeated cycle as the control pulses in an active period ACk.

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to receive the clock control signal CPV and the blanking enable signal BEN from the timing controller 200 and to receive a preset voltage VD from the driving voltage generator 300. The preset voltage VD has a level between the gate-on voltage VON and the second gate-off voltage VSS2. For example, the preset voltage VD may be a ground voltage GND (e.g., about 0 V) or an input voltage PVDD (e.g., about 5 V) which is inputted to the driving voltage generator 300.

The gate controller 400 is configured to generate first and second clock signals CK1 and CK2 based on the clock control signal CPV and the blanking enable signal BEN. The first and second clock signals CK1 and CK2 swing between the preset voltage VD and the second gate-off voltage VSS2 in the vertical blanking period VBk and swing between the gate-on voltage VON and the second gate-off voltage VSS2 in the active period.

The first and second clock signals CK1 and CK2 have a same phase as each other in the vertical blanking period VBk and an opposing phase to each other in the active period ACk. However, the first and second clock signals CK1 and CK2 in the vertical blanking period VBk have a same repeated cycle and a same duty ratio as those in the active period ACk.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

Figure 11:
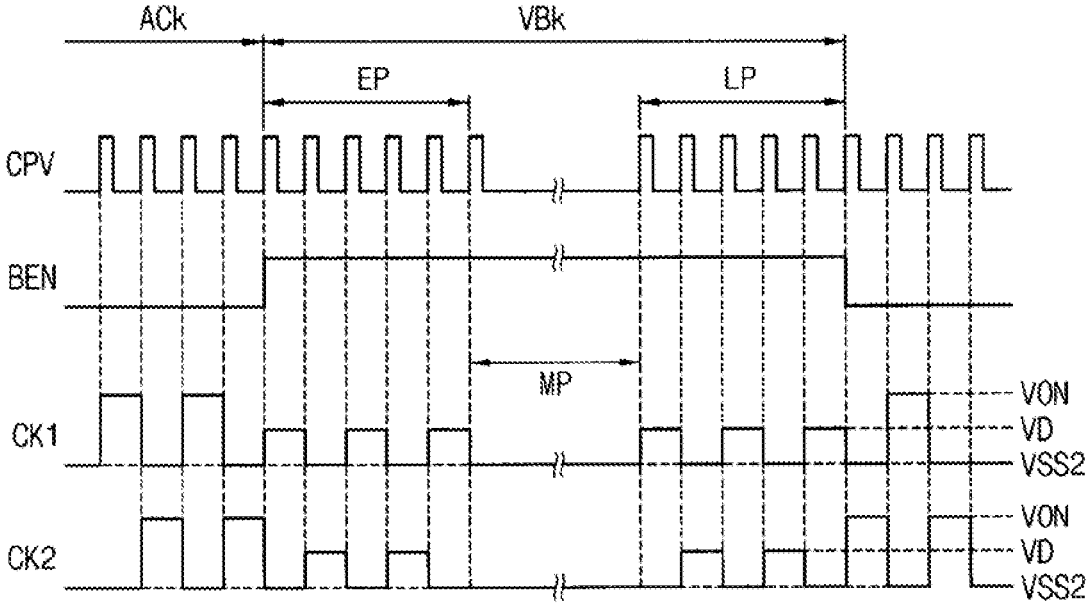
FIG. 11 is a timing chart illustrating a plurality of driving signals for driving a gate driver according to an exemplary embodiment.

FIG. 11 is a timing chart illustrating a plurality of driving signals for driving a gate driver according to an exemplary embodiment.

Referring to FIGS. 1 and 11, according to an exemplary embodiment, the timing controller 200 is configured to mask control pulses of an original clock control signal in a middle portion MP of the vertical blanking period VBk and to not mask control pulses of the original clock control signal in an early and late portions EP and LP of the vertical blanking period VBk, to generate a clock control signal CPV. A length of the early portion EP may be equal to or different from that of the late portion LP. For example, the early and late portions EP and LP may respectively correspond to m horizontal periods (mH) (wherein, 'm' is a natural number and 'H' is a horizontal period).

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to receive the clock control signal CPV and the blanking enable signal BEN from the timing controller 200 and to receive a preset voltage VD from the driving voltage generator 300.

The preset voltage VD has a level between the gate-on voltage VON and the second gate-off voltage VSS2. For example, the preset voltage VD may be a ground voltage GND (e.g., about 0 V) or an input voltage PVDD (e.g., about 5 V) which is inputted to the driving voltage generator 300.

The gate controller 400 is configured to generate first and second clock signals CK1 and CK2 based on the clock control signal CPV and the blanking enable signal BEN. The first and second clock signals CK1 and CK2 are synchronized with the clock control signal CPV.

The first and second clock signals CK1 and CK2 swing between the preset voltage VD and the second gate-off voltage VSS2 in the early portion EP and the late portion LP of the vertical blanking period VBk and maintain the second gate-off voltage VSS2 the middle portion MP of the vertical blanking period VBk.

According to the exemplary embodiment, in the early and late portions EP and LP of the vertical blanking period VBk, the first and second clock signals CK1 and CK2 have an opposing phase to each other, and have a same repeated cycle and a same duty ratio as the first and second clock signals in the active period ACk.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

Figure 12:
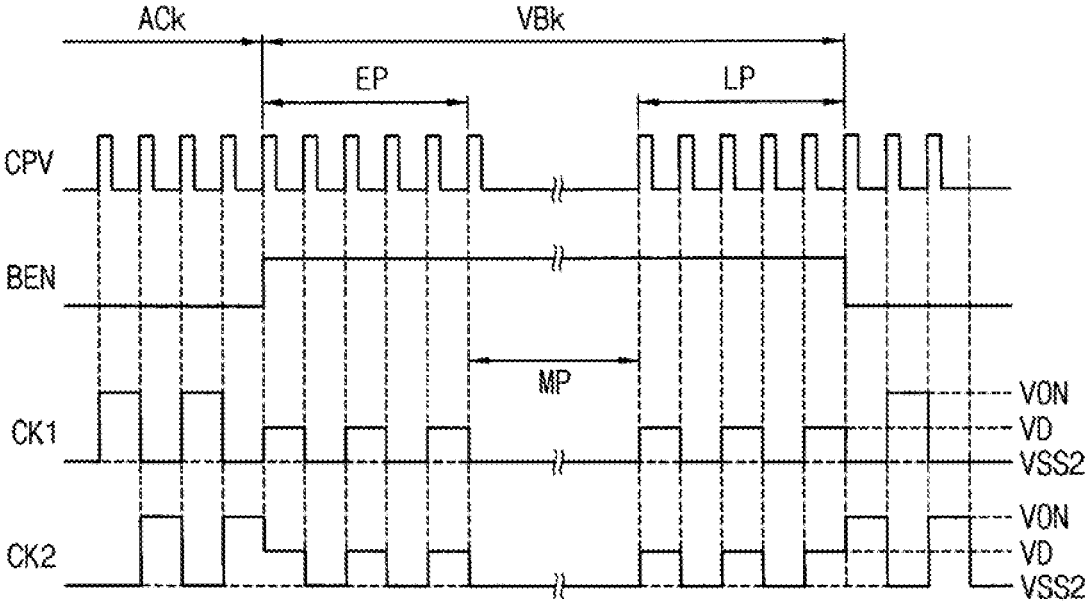
FIG. 12 is a timing chart illustrating a plurality of driving signals for driving a gate driver according to an exemplary embodiment.

FIG. 12 is a timing chart illustrating a plurality of driving signals for driving a gate driver according to an exemplary embodiment.

Referring to FIGS. 1 and 12, according to an exemplary embodiment, the timing controller 200 is configured to mask control pulses of an original clock control signal in a middle portion MP of the vertical blanking period VBk and to not mask control pulses of the original clock control signal in an early and late portions EP and LP of the vertical blanking period VBk, to generate a clock control signal CPV. A length of the early portion EP may be equal to or different from that of the late portion LP. For example, the early and late portions EP and LP may respectively correspond to m horizontal periods (mH) (wherein, 'm' is a natural number and 'H' is a horizontal period).

The timing controller 200 is configured to generate a blanking enable signal BEN maintaining a high level in the vertical blanking period VBk.

The timing controller 200 is configured to output the clock control signal CPV and the blanking enable signal BEN to the gate controller 400.

The gate controller 400 is configured to receive the clock control signal CPV and the blanking enable signal BEN from the timing controller 200 and to receive a preset voltage VD from the driving voltage generator 300.

The preset voltage VD has a level between the gate-on voltage VON and the second gate-off voltage VSS2. For example, the preset voltage VD may be a ground voltage GND (e.g., about 0 V) or an input voltage PVDD (e.g., about 5 V) which is inputted to the driving voltage generator 300.

The gate controller 400 is configured to generate first and second clock signals CK1 and CK2 based on the clock control signal CPV and the blanking enable signal BEN. The first and second clock signals CK1 and CK2 are synchronized with the clock control signal CPV.

The first and second clock signals CK1 and CK2 swing between the preset voltage VD and the second gate-off voltage VSS2 in the early portion EP and the late portion LP of the vertical blanking period VBk and maintain the second gate-off voltage VSS2 the middle portion MP of the vertical blanking period VBk.

According to the exemplary embodiment, in the early and late portions EP and LP of the vertical blanking period VBk, the first and second clock signals CK1 and CK2 have a same phase as each other, and have a same repeated cycle and a same duty ratio as the first and second clock signals in the active period ACk.

Therefore, the first and second clock signals CK1 and CK2 in the vertical blanking period VBk includes an ON period having the gate-on voltage VON and an OFF period having the second gate-off voltage VSS2, and the ON period is shorter than the OFF period. The ON period in which the gate-on voltage is applied to the third, tenth and eleventh transistors T3, T10 and T11 of the gate driver, may decrease and thus, the third, tenth and eleventh transistors T3, T10 and T11 may be prevented from being degraded.

In addition, according to the exemplary embodiment, the first and second clock signals CK1 and CK2 in the vertical blanking period VBk may have a similar waveform as those in the active period ACk, and thus, a load change may decrease in a boundary period between the vertical blanking period VBk and the active period. Therefore, power supply ripple noise occurring by the load change may be removed.

According to the exemplary embodiments, toggling of the first and second clock signals may decrease in the vertical blanking period and thus, consumption of electrical power may decrease. In addition, the ON period in which the first and second clock signals have the gate-on voltage may decrease in the vertical blanking period and thus, the transistors of the gate driver may be prevented from being degraded. In addition, the first and second clock signals in the vertical blanking period may have a similar waveform as those in the active period. Thus, a load change may decrease in a boundary period between the vertical blanking period and the active period and power supply ripple noise occurring by the load change may be removed.

In the above-described exemplary embodiments, it shall be understood that the relatively low level of the gate signal in at least the middle portion of the vertical blanking period, which may both reduce power consumption and reduce transistor degradation and thereby minimize degradation of signal strength, is particularly applicable to an amorphous silicon gate (ASG) type of gate driving circuit, but not limited thereto. Moreover, the duration of the middle portion may be extended into the early and late portions of the vertical blanking period for even greater reductions of power consumption and transistor degradation with the design trade-off of potentially increased ripple effects. Although such ripple effects may, in turn, be reduced by increasing transistor size and/or channel width versus length, it is preferable to maintain some early and late portion activity to minimize power fluctuations at the transitions between the vertical blanking period and the active period. During a vertical blanking period versus an active period of a frame cycle, the clock signals may have reduced amplitude, reduced duration, same rather than opposite phase, reduced duty cycle, or any combination thereof. Thus, the inventive concept supports embodiments where the mean amplitude of a clock signal in a vertical blanking period of a frame cycle is smaller than the mean amplitude of the clock signal in an active period of the frame cycle.

The foregoing is illustrative of the inventive concept and is not to be construed as limiting thereof. Although a few exemplary embodiments of the inventive concept have been described, those of ordinary skill in the pertinent art will readily appreciate that many modifications are possible in the exemplary embodiments without materially departing from the novel teachings and advantages of the inventive concept. Accordingly, all such modifications are intended to be included within the scope of the inventive concept as defined in the claims.

What is claimed is:

1. A display apparatus comprising:

a display panel comprising a pixel which is connected to a gate line and a data line;

a gate driver configured to generate a gate signal that swings between a gate-on voltage and a gate-off voltage and to provide the gate line with the gate signal; and a gate controller configured to generate a first clock signal and a second clock signal based on a clock control signal and to provide the gate driver with the first and second clock signals, wherein, during an active period and an early portion of a vertical blanking period following the active period, each of the first and second clock signals has a plurality of pulses and the second clock signal has a phase different from the first clock signal, and wherein, during a middle portion of the vertical blanking period following the early portion, both of the first and second clock signals have a low level simultaneously, and during a late portion of the vertical blanking period following the middle portion, each of the first and second clock signals has a plurality of pulses and the second clock signal has a phase different from the first clock signal.

2. The display apparatus of claim 1, wherein a length of the middle portion is longer than a period of the first clock signal and a period of the second clock signal.

3. The display apparatus of claim 1, wherein a length of the early portion is equal to that of the late portion.

4. The display apparatus of claim 3, wherein the length of the early and late portions corresponds to m horizontal periods where 'm' is a natural number.

5. The display apparatus of claim 1, wherein a length of the early portion is different from that of the late portion.

6. The display apparatus of claim 1, wherein, during the active period and the early portion of the vertical blanking period, the clock control signal has a plurality of control pulses, and wherein, during the middle portion of the vertical blanking period, the clock control signal has the low level.

7. The display apparatus of claim 6, further comprising:

a timing controller configured to generate the clock control signal.

8. The display apparatus of claim 7, wherein the timing controller is configured to mask control pulses of an original clock control signal in the middle portion of the vertical blanking period and to not mask control pulses of the original clock control signal in the early portion of the vertical blanking period, to generate the clock control signal.

9. The display apparatus of claim 1, wherein, during the active period and the early portion of the vertical blanking period, the second clock signal has a phase opposite to the first clock signal.

10. The display apparatus of claim 1, wherein, during the vertical blanking period, each of the first and second clock signals has an ON period having a high level and an OFF period having the low level, and the ON period is shorter than the OFF period.

11. The display apparatus of claim 1, wherein the gate line is an n-th gate line, the gate signal is an n-th gate signal, where n is a natural number, the gate driver comprises a plurality of shift registers including a (n−1)-th shift register, a n-th shift register, a (n+1)-th shift register and a (n+2)-th shift register, each of the plurality of shift registers having an output terminal connected to a respective gate line, wherein the n-th shift register comprises: a first clock terminal, a second clock terminal, a first input terminal, a second input terminal, a third input terminal, a first voltage terminal, a second voltage terminal, a carry terminal that outputs a carry signal, and the output terminal connected to the n-th gate line;

wherein during the active period:

the first clock terminal receives the second clock signal;

the first input terminal receives an (n−1)-th carry signal outputted from the (n−1)-th shift register;

the second input terminal receives an (n+1)-th carry signal outputted from the (n+1)-th shift register; and the third input terminal receives an (n+2)-th carry signal outputted from the (n+2)-th shift register.

12. The display apparatus of claim 11, wherein the first voltage terminal receives a first gate-off voltage VSS1 having a first low level corresponding to a discharge level of the gate signal.

13. The display apparatus of claim 12, wherein the second voltage terminal receives a second gate-off voltage VSS2 having a second low level lower than the first low level, the second low level corresponding to a discharge level of a control node Q in the n-th shift register.

14. The display apparatus of claim 13, wherein the n-th shift register comprises a buffer circuit part, a pull-up circuit part, a carry circuit part, a first control pull-down circuit part, a second control pull-down circuit part, a control holding circuit part, an output pull-down circuit part, an output holding circuit part and a carry holding circuit part.

15. The display apparatus of claim 14, wherein the buffer circuit part is configured to transfer the (n−1)-th carry signal to the control node Q, and comprises a transistor T4 including a control electrode and an input electrode connected to the first input terminal, and an output electrode connected to the control node Q, wherein when the buffer circuit part receives a gate-on voltage VON of the (n−1)-th carry signal CRn-1, a first voltage corresponding to the gate-on voltage VON is applied to the control node Q.

16. The display apparatus of claim 14, wherein the carry circuit part is configured to output a gate-on voltage VON of the second clock signal received in the first clock terminal as an n-th carry signal in response to a high voltage of the control node Q, the n-th carry signal being outputted through the carry terminal of the n-th shift register.

17. The display apparatus of claim 14, wherein the first control pull-down circuit part and second control pull-down part are configured to sequentially discharge the control node Q to the second gate-off voltage VSS2 in response to the (n+1)-th carry signal and the (n+2)-th carry signal provided from the (n+1)-th shift register and the (n+2)-th shift register, respectively.

18. The display apparatus of claim 14, wherein the first control pull-down part includes a transistor T9 having a control electrode connected to the second input terminal, an input electrode connected to the control node Q and an output electrode connected to the second voltage terminal, wherein when a gate-on voltage VON of the (n+1)-th carry signal is applied to the second input terminal in a (n+1)-th horizontal period, the transistor T9 is configured to discharge the control node Q to the second gate-off voltage VSS2.

* * * * *